United States Patent [19]

Dicker

[11] Patent Number: 4,951,864

[45] Date of Patent: Aug. 28, 1990

[54] ONE-PIECE MAILER AND APPARATUS FOR FOLDING SAME

[75] Inventor: David Dicker, Scarsdale, N.Y.

[73] Assignee: Transkrit Corporation, Granville, N.Y.

[21] Appl. No.: 108,075

[22] Filed: Oct. 13, 1987

Related U.S. Application Data

[63] Continuation-in-part of Ser. No. 942,349, Dec. 16, 1986, abandoned, which is a continuation-in-part of Ser. No. 856,574, Apr. 25, 1986, abandoned.

[51] Int. Cl.[5] ..... B65D 27/14

[52] U.S. Cl. ..... 229/80; 229/92.3

[58] Field of Search ..... 229/69, 80, 71, 92, 229/92.1, 92.3, 73

[56] References Cited

U.S. PATENT DOCUMENTS

| | | | |
|---|---|---|---|
| 3,339,828 | 9/1967 | Hiersteiner | 229/69 |
| 3,652,007 | 3/1972 | MacDougall | 229/73 |
| 3,845,698 | 11/1974 | Scholle | 93/61 R |
| 3,911,862 | 10/1975 | Lupkas | 118/7 |
| 4,284,230 | 8/1981 | Schultz | 229/73 |
| 4,450,037 | 5/1984 | Gavronsky | 156/441.5 |
| 4,706,878 | 11/1987 | Lubotta et al. | 229/73 |

FOREIGN PATENT DOCUMENTS

| | | | |
|---|---|---|---|
| 0100674 | 2/1984 | European Pat. Off. . | |
| 0110842 | 6/1984 | European Pat. Off. . | |
| 0193726 | 9/1986 | European Pat. Off. . | |
| 808706 | 2/1937 | France | 229/92.3 |
| 1538530 | 7/1968 | France | 229/92.3 |
| 0588318 | 5/1947 | United Kingdom . | |
| 0692856 | 6/1953 | United Kingdom . | |
| 1144401 | 3/1969 | United Kingdom . | |
| 1173776 | 12/1969 | United Kingdom . | |
| 2029371 | 3/1980 | United Kingdom | 229/92.3 |

*Primary Examiner*—Willis Little

*Attorney, Agent, or Firm*—Kenyon & Kenyon

[57] ABSTRACT

The apparatus for folding and sealing a mailer blank includes a water applicator for activating remoistenable glue strips or lines on the mailer blank prior to folding into a mailer or envelope. The glue is disposed along the longitudinal edges as well as a transverse edge. One mailer section forms a flap with glue for sealing the mailer.

32 Claims, 3 Drawing Sheets

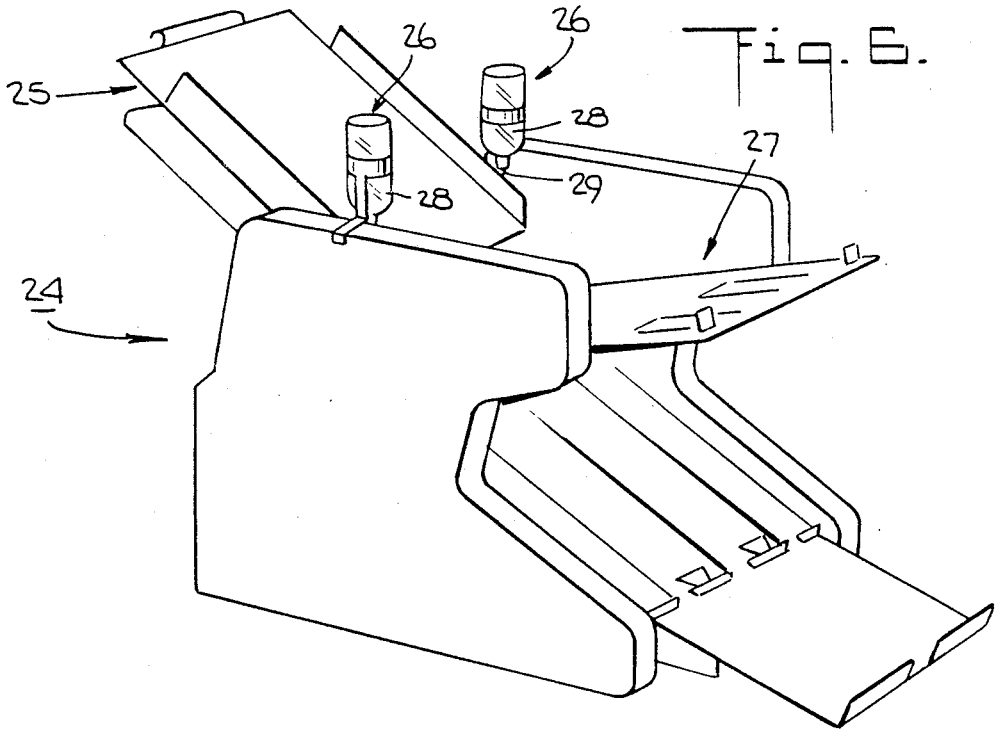
Fig. 6.
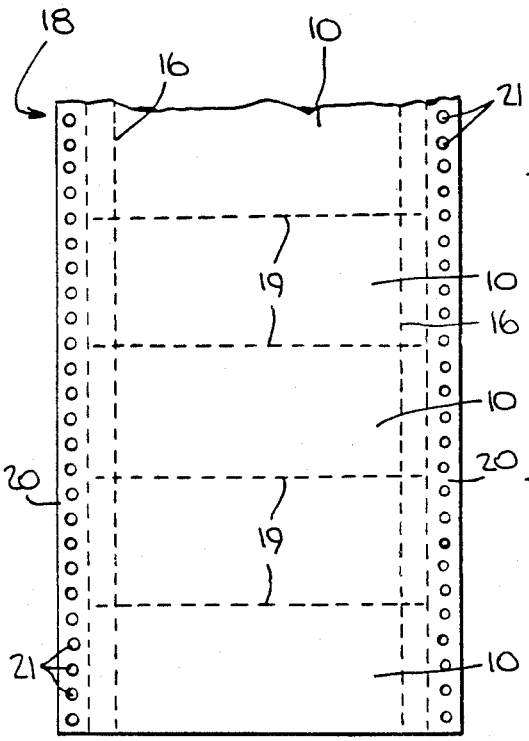
Fig. 5.
Fig. 7.
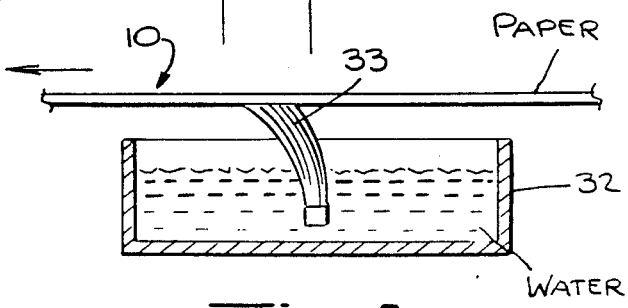
Fig. 8.
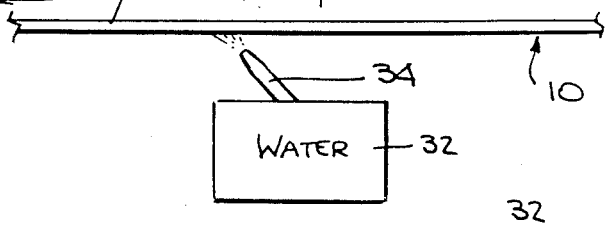
Fig. 9.
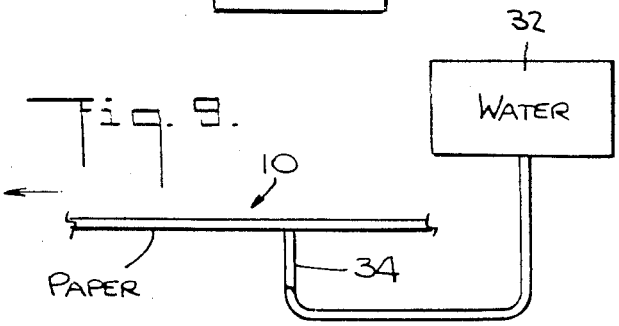

ONE-PIECE MAILER AND APPARATUS FOR FOLDING SAME

This is a continuation-in-part of U.S. patent application Ser. No. 942,349, filed Dec. 16, 1986 (now abandoned) which is a continuation-in-part of U.S. patent application Ser. No. 856,576, filed Apr. 25, 1986 now abandoned.

This invention relates to a one piece mailer and to an apparatus for folding a one-piece mailer. More particularly, this invention relates to a one-piece mailer, an assembly of interconnected one-piece mailers and an apparatus for folding and sealing a one-piece mailer.

Heretofore, various types of one-piece constructions have been known for the fabrication of a mailer. For example, U.S. Pat. No. 4,055,294 describes a continuous web from which a series of connected one-piece assemblies are constructed. In this case, various lines of perforations are provided in the web so that the web may be folded about a longitudinal score line so that one portion overlies another portion of the web in order to define return envelope pockets therebetween. Other lines of perforations are also provided to permit the remaining web portion to be folded over the previously folded portions to form a series of three-ply mailers. In this construction, use is made of a previously applied adhesive which is activated by heat in order to secure the folded over portions together.

Other types of assemblies have also been known wherein various plies of a mailer are folded over on each other and secured in place by a regular adhesive. However, these adhesives tend to be hot melt adhesives or other adhesives which are activated by heat in order to secure the folded portions together.

In the case where users process streams of mailers, for example of the interconnected or single sheet type with hot melt, heat seal adhesives through laser printers, a difficulty arises in their inherent incompatibility with heat generating non-impact printer fuser stations which transfer and fuse variable computer information to the form since the heat generating fuser stations create intense heat, often exceeding 400 Degrees F. and are part of the printer paper path. If forms with heat seal adhesive come in contact with such heat generating fuser stations, the heat will activate the heat seal adhesive and damage both the printer and the heat seal form.

Regular adhesives when used on mailers and exposed so as to come into contact with heat generating fuser stations will also break down and can damage both printer and form.

Various types of one-piece mailers have also been known wherein a blank is formed with two main portions to the form the front and back of an envelope and a plurality of foldable tab portions which are provided with glue so as to be secured to one or both of the main portions when attached to or folded over onto these portions such as described in U.S. Pat. No. 3,360,184. Such blanks however require multiple folding steps and if use is made of heat activated adhesives, similar problems arise as in the case of mailers. Specifically, the folding equipment requires some form of heater in order to activate the hot melt glues so as to form a sealed envelope. Such constructions tend to not only be costly but are inherently incompatible with heat fuse continuous or single sheet fed non-impact printers (heat seal adhesive would be activated during printing and damage printer and form). Thus, many complications arise in attempting to provide a simple, inexpensive self mailer for non-impact printer users.

Accordingly, it is the object of the invention to provide a one part continuous self mailer construction of interconnected one part blanks or single sheet mailer constructions using a heat resistant remoistenable glue and heat resistant printing press inks that will permit the mailer to process through continuous or sheet fed non-impact printers with heat and/or pressure generating fuser stations.

It is another object of the invention to provide a glue containing self mailer able to withstand intense heat often exceeding 400 Degrees F.

It is another object of the invention to allow nonimpact printers to image variable information including variable address information on one side and then by folding and sealing the form and exposing the address through a die cut window with or without a transparent material patch to create a folded, sealed and addressed mailer.

It is another object of the invention to provide a one-piece mailer of simple construction which can be readily folded and sealed in a simple, economical manner.

It is another object of the invention to provide a simple and economic apparatus for the folding and sealing of one-piece mailers.

Briefly, the invention provides a one piece mailer blank, for example of paper, having contiguous sections disposed for folding over on each other and wherein each section has a pair of heat resistant remoistenable glue strips along the respective longitudinal edges for bonding the facing sections together when folded. The mailer may be constructed with two or three foldable sections. In addition, the mailer blank may be provided with one or two transverse fold lines to permit subsequent folding of a blank into a two-ply mailer or three-ply mailer.

The one-piece mailer may also have heat resistant remoistenable glue disposed near a transverse edge for bonding to the other sections. Whether the mailer is a two-ply or three-ply mailer, this glue serves to seal the mailer transversely across the mailer without leaving a gap which might be inadvertently opened.

The mailer may also be provided with pre-printed information to which variable information may be added during porocessing through printers of non-impact or impact type.

The invention also provides a mailer assembly having a plurality of interconnected one-piece mailer blanks which are separated from each other by transverse burstable lines of weakening. In this respect, the mailer assembly is of one-ply construction and is provided with removable strips of control holes along the longitudinal edges to facilitate feeding through various types of automatic machinery, for example, a non-impact laser printer.

After the mailer assembly has been processed, for example, through a laser printer which provides the mailer with information, such as an address of a recipient, address of a sender and other information, each mailer blank is separated from the assembly, if continuous, by bursting along a transverse line of weakening. Thereafter, water is applied to the edges of each mailer to activate the glue strips and the blank is folded with the folded over sections being pressed together in order to effect a bonding of the sections together via the water-activated glue strips.

When the blanks also have glue along a transverse edge, this glue is also activated by the application of water along the transverse edge or on the opposite transverse edge to the glue on the blank prior to folding of the blank. When the blank is folded, the glue comes into contact with the moistened paper or the paper comes into contact with the moistened glue thus effecting a bonding of the transverse edge to a facing mailer section.

Where the assembly to be processed is to be processed for use in making envelopes, each blank may be provided with a built-in return envelope and the address of a recipient. In addition, the fold lines can be located differently so that after each blank, whether a single sheet or burst from a continuous assembly, the result is an outgoing envelope with a built in top open return envelope with a remoistenable glue flap. Each blank may also be provided with a return address of a bulk user and the address of a recipient. In addition, the fold lines can be located differently so that after each blank is burst from the assembly and subsequently folded, the result is an envelope with an unsealed flap.

The invention also provides an apparatus for folding and sealing the mailer blanks into mailers. This apparatus includes a feed means for receiving and conveying a one-piece mailer blank with remoistenable glue strips thereon, means for applying water to at least one side of the conveyed mailer blank along each longitudinal edge in order to activate the glue, and means for folding the sections of the mailer blank into overlying relation while pressing the opposed longitudinal edges together in order to permit the activated glue strips to bond the edges together and form a sealed unit.

The folding apparatus may be of generally conventional structure modified to have a means for applying water to the edge areas of the conveyed mailer blanks. In this regard, the means for applying the water may include a water reservoir disposed below the conveyed mailer blanks and an applicator, such as a rotatably mounted wheel or capillary brush, for transferring water from the reservoir to the underside of a conveyed blank. Alternatively, the means for applying the water may include a water reservoir and a nozzle which communicates with the reservoir and is directed towards a conveyed blank for transferring water to the conveyed blank by pressure or by gravity.

Where the blanks are provided with glue along a transverse edge, the folding apparatus also includes a similar means for applying water to the conveyed blanks along the transverse edge or opposite the transverse edge so when the form is folded either the moistened transverse glue comes into contact with the paper or the moistened paper comes into contact with the transverse glue.

The invention further provides a self mailer construction of interconnected one piece blanks as well as a single sheet mailer having heat resistant remoistenable glue as well as heat resistant printing press inks that permit the constructions to be processed through continuous or sheet feed non-impact printers with heat and/or pressure generating fuser stations in a lay flat condition without curling up of the edges of the constructions.

The invention also provides a system which is comprised of a supply or blanks, a printer for imaging the blanks and an apparatus for folding and sealing a blank received from the printer. In this respect, each blank has at least a pair of foldable sections and a remoistenable glue on at least one section for securing the sections together upon folding.

These and other objects and advantages of the invention will become more apparent from the following detailed description taken in conjunction with the accompany drawings wherein:

FIG. 5 illustrates a view of a continuous mailer assembly in accordance with the invention;

FIG. 6 illustrates a folding machine incorporating a plurality of water applicators in accordance with the invention;

FIG. 7 illustrates a modified means for applying water to the underside of a one-piece mailer blank in accordance with the invention;

FIG. 8 illustrates a further modified means for applying water to a conveyed mailer blank;

FIG. 9 illustrates a modified means for applying water to a mailer which operates under gravity;

Figure 1:
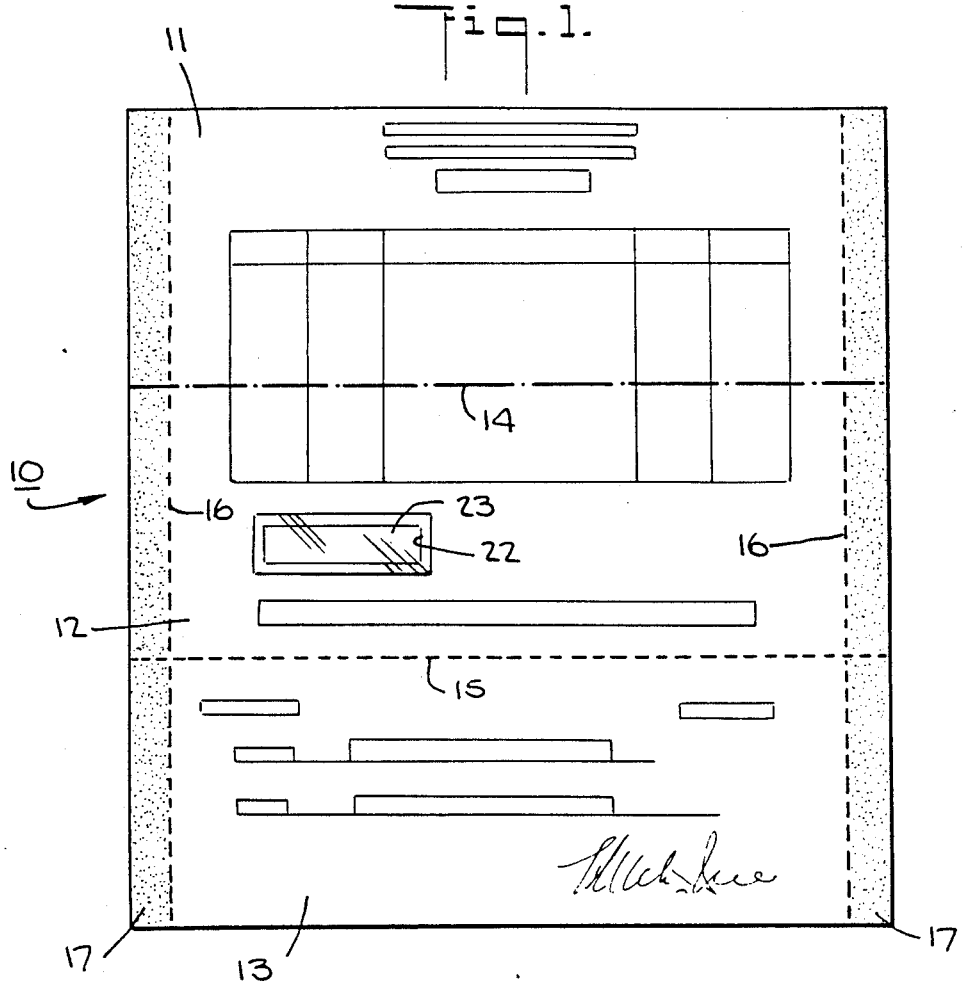
FIG. 1 illustrates a plan view of a one-piece mailer blank constructed in accordance with the invention.

Referring to FIG. 1, the one-piece mailer is formed from a flat blank of paper 10 of rectangular shape which is divided into three longitudinally disposed contiguous sections 11, 12, 13 by transverse fold lines 14, 15, a pair of longitudinal perforations 16, or other like lines of weakening extended along the blank 10 approximately one-half (½) inch from the respective longitudinal edges. Each section 11, 12, 13 is also provided with a pair of remoistenable glue strips 17 along and between each respective longitudinal edge and a perforation 16. For example, each glue strip is ½ inch wide for a blank having a width of 8½ inches. The remoistenable glue is made of any suitable heat resistant glue which can be reactivated with water. In particular, the glue is characterized in being able to withstand temperatures exceeding 400° F. while providing "lay flat" characteristics when applied. In this respect, "lay flat" means that the paper is not curled by the glue when applied nor is the paper curled after exposure to humidity after application.

By way of example, the glue may be a vinyl acetate compolymer dispersion adhesive, such as a vinyl acetate homopolymer emulsion base having a 58–61% solids content, a formulated resin adhesive with dextrine having a 66% solids content or a resin remoistening adhesive having a 66% solids content.

The one-piece mailer blank 10 also has remoistenable glue in the form of a cross-web array of glue dots 17' disposed near a transverse edge, i.e. the top edge as viewed, of the upper section 11. These glue dots 17' are made of the same glue as the glue strips 17. Alternatively, the dots 17' may be replaced by blocks or a line of glue.

Referring to FIG. 5, the mailer assembly 18 is formed of a plurality of interconnected one-piece mailer blanks 10 which are separated by transverse burstable lines of weakening 19. In addition, the assembly 18 includes longitudinal strips 20 which are provided with control holes 21, for example for feeding through a laser printer (not shown) for the application of information to the various mailer blanks 10. For example, use may be made of any continuous fed printer having a heat generating fuser station.

As indicated in FIG. 1, each mailer blank 10 can be imprinted with information such that the upper two sections 11, 12, as viewed, form a voucher including the address of a recipient while the lower section 13 is printed, for example as a check. In this case, the lower fold line 15 is made as a line of weakening, e.g., a perforation, to permit the section 13 to be subsequently separated from the section 12 while also laying flat to avoid jamming in a printer. In addition, the backside of the mailer blank 10 may be provided with information, such as the return address of a sender, for example in one corner of the middle section 12. In addition, the middle section 12 is provided with a cut-out or die-cut window 22 and an overlying transparent panel such as a plastic film 23 to permit viewing of a printed address of the recipient on one section 13. After feeding the mailer assembly 18 through the printer, the longitudinal strips 20 may be removed and, thereafter, the individual mailer blanks 10 can be separated from the assembly 18 by bursting across the lines of weakening 19.

The mailer assembly 18 constitutes a one part continuous self- mailer construction of interconnected blanks 10 which may be provided with preprinted information using a heat resistent printing press ink which can be further processed through a continuous or sheet fed non-impact printer with heat and/or pressure generating fuser stations. In this respect, the heat resistant printing press inks and the heat resistant remoistenable glue used in the assembly 18 would be able to withstand intense heat often exceeding 400° F. with the glue providing "lay flat" characteristics when applied. In this respect, the lay flat characteristics of the glue are vital to the feeding of the self-mailer 18 through the sensitive feed paths of continuous and sheet fed non-impact printers.

The self mailer 18 may also be provided with variable information, such as address information, by means of a nonimpact printer. For example, the variable information may be imaged on one side of a blank 10 with the blank 10 being subsequently folded and sealed with the address information exposed through the cut out 22.

If non-impact imaging is required on both sides of a mailer blank 10, the cut-out 22 and transparent panel 23 may be eliminated as the address can be imaged on the other side of the blank 10 during the imaging process.

After being burst from the mailer assembly 18, each mailer blank 10 can be delivered to a folding and sealing machine or apparatus 24. In this regard, as indicated in FIG. 6, the machine 24 includes a tray 25 for receiving a stack of mailer blanks 10, means 26 for applying water to at least one side of the blank 10 along each longitudinal edge in order to activate the glue and means (not shown) for folding the sections 11, 12, 13 into overlying relation while pressing the opposed or facing longitudinal edges together to permit the activated glue strips 17 and 17′ to bond the edges together.

The machine 24 is of conventional structure and need not be further described. For example, in the case of a machine sold by Pitney Bowes as a Desk Top Folding Machine, Model 1831 or any similar manufacturers Desk Top Folder, a feed means 27 in the form of a friction feed roller (FIG. 2) is provided to individually convey the blanks 10 from the tray 25.

The means 26 for applying water includes a pair of water reservoirs 28 each of which is mounted on the machine 24, a plastic tube 29 for delivering water from the reservoir 28 and an applicator 30 for transferring water from the respective reservoir 28 via the tube 29 to the edge of the conveyed blank 10. In this regard, as indicated in FIG. 2, each blank 10 is conveyed with the glue side facing the respective applicator 30.

Figure 2:
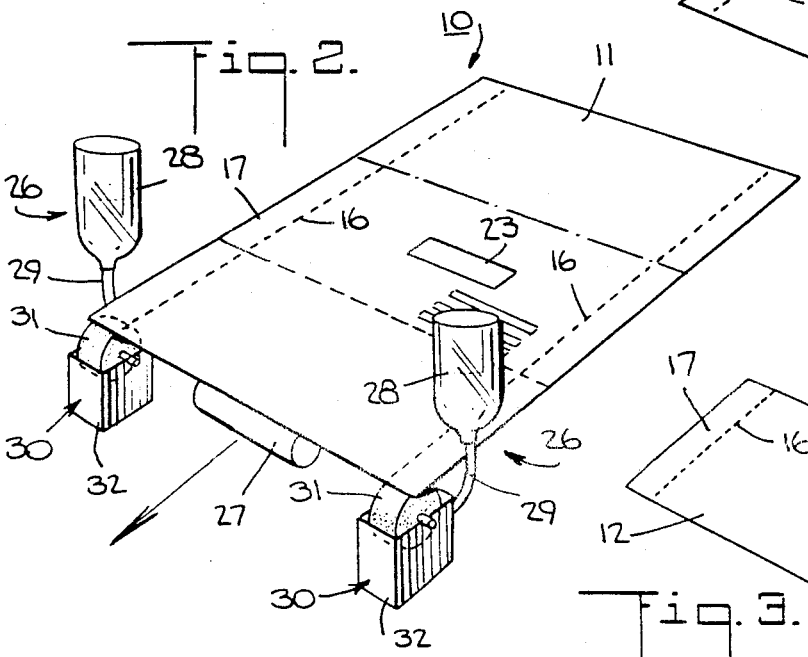
FIG. 2 illustrates the position of the blank of FIG. 1 as conveyed within a folding machine in accordance with the invention.

Referring to FIG. 2, each water applicator 30 is in the form of a rotatably mounted wheel 31 which is capable of picking up water from a reservoir 32 for application to the underside of the blank 10.

Alternatively, as shown in FIG. 7, the applicator may be a brush 33 which extends upwardly from the reservoir 32 for wetting the conveyed blank 9 by capillary action.

As indicated in FIG. 8, the water applicator may be in the form of a nozzle 34 which communicates with the reservoir 32 so as to spray water onto the blank 10. Still further, as indicated in FIG. 9, the reservoir 32 may be disposed above the plane of the blank 10 so that water is fed by gravity through the nozzle 34.

Figure 4:
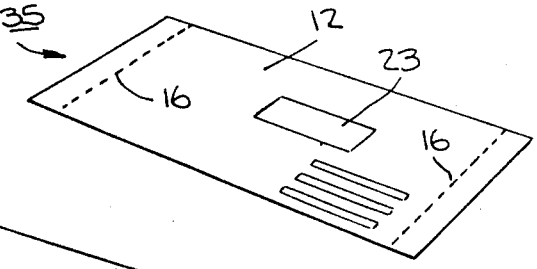
FIG. 4 illustrates a perspective view of a one piece mailer in accordance with the invention.
Figure 3:
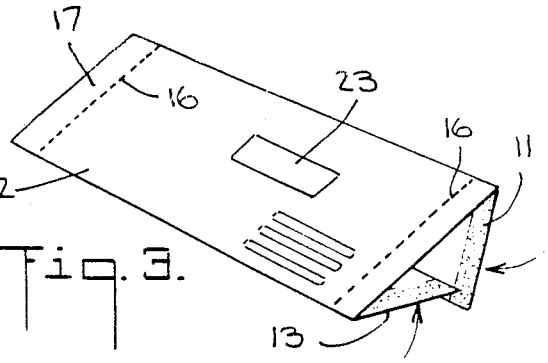
FIG. 3 illustrates a perspective view of the manner in which the blank of FIG. 1 is folded in the folding machine in accordance with the invention.
Figure 11:
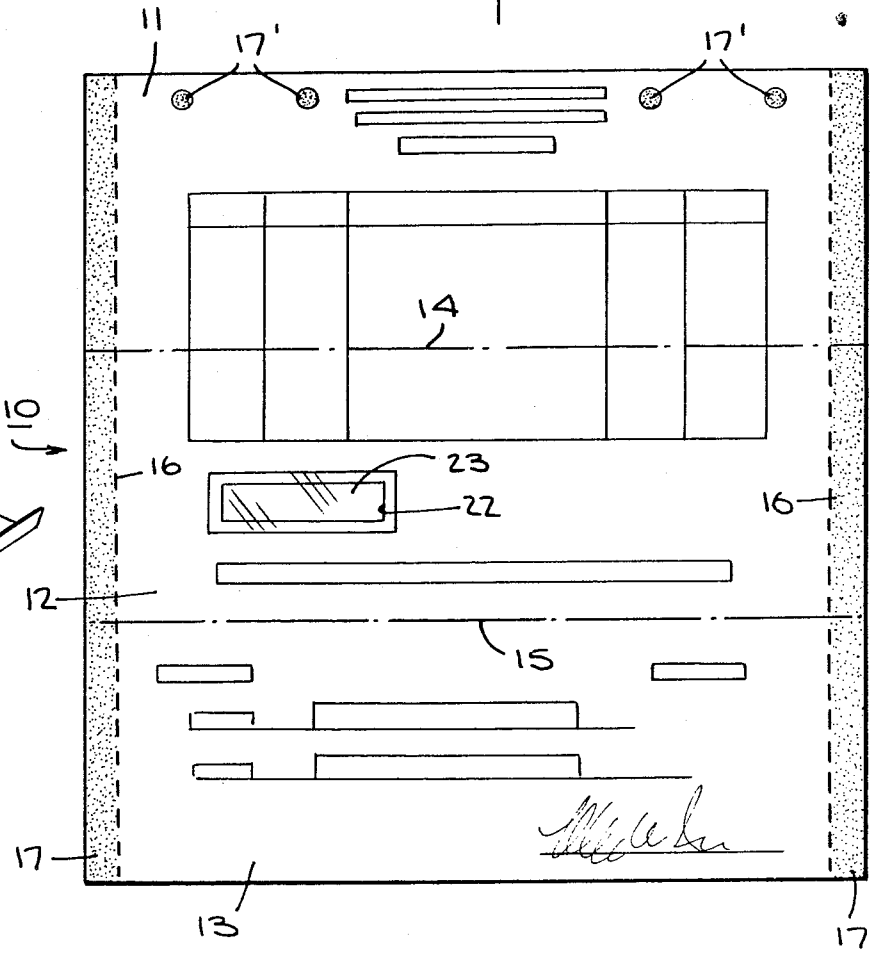
FIG. 11 illustrates a view of a mailer blank having remoistenable glue spots at a transverse edge.

Referring to FIG. 3, the means for folding the sections 11, 12, 13 of the blank 10 is of conventional structure which employs folding plates which function to fold the blanks 10 on each other to form a three-ply mailer 35, for example, as shown in FIG. 4. The mailer 35 can then be mailed in a conventional manner.

As indicated in FIG. 3, once the glue strips 17 and 17′ have been activated by the application of water, the check forming section 13 is folded up against the middle section 12 with the respective glue strips in facing relation to each other. Thereafter, the remaining section 11 can be folded up so that the glue strips 17 thereon face an unglued surface of the section 13. During pressing of the sections together along the edges, the glue serves to bond the sections together into a sealed unit at the ends of the mailer 34.

Of note, depending on the folding machine, the water applicators may be positioned to apply water to the downside of a blank as in FIG. 2 or the upside of a blank. In either case, the glue strips would be in facing relation to the applicators.

Referring to FIG. 4, when a recipient receives the mailer 35, both edges may be torn off along the overlying perforations 16 so as to permit the remainder to be opened flat. The lower section 13 can then be removed along the perforations 15 where made as a check.

Figure 10:
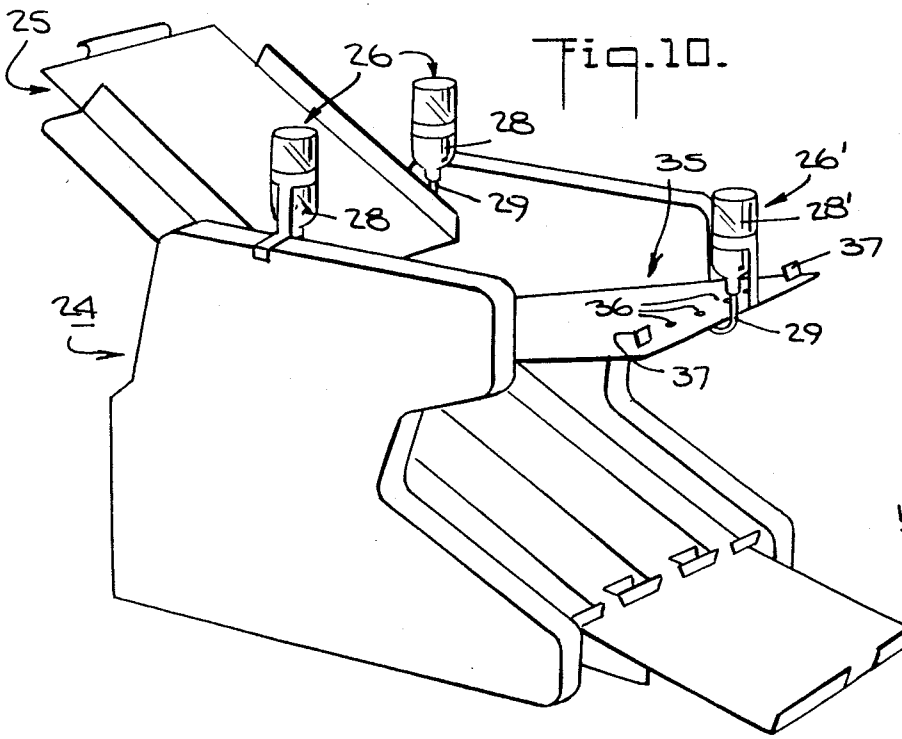
FIG. 10 illustrates a modified folding machine for activating glue on a transverse edge of a blank.

Referring to FIG. 10, the machine 24 may also include means 26′ for applying water to the blank 10 along a transverse top edge, as viewed, in order to activate the glue dots 17′ which may be present. In this case, the water applying means 26′ includes a reservoir 28′ which is mounted at the upper end of a tray 35 for the folding means (not shown).

As above, a plastic tube 29′ extends from the reservoir 28′ to an applicator (not shown) positioned under and in line with holes 36 in the tray 35 in order to transfer water to the leading transverse edge of a conveyed blank 10 on which the glue dots 17′ are disposed. As indicated, suitable stops 37 are provided to stop movement of the blanks from the tray 35.

After a blank 10 has been moistened along two longitudinal edges and the one transverse edge, the sections 11, 12, 13 are folded and pressed, as above, with the remoistenable glue dots 17' of the top section 11 facing and bonding to the unglued surface of the check forming section 13. A completely sealed unit is then obtained, i.e. a unit which is sealed at the sides as well as across the top (or bottom as the case may be).

Figure 12:
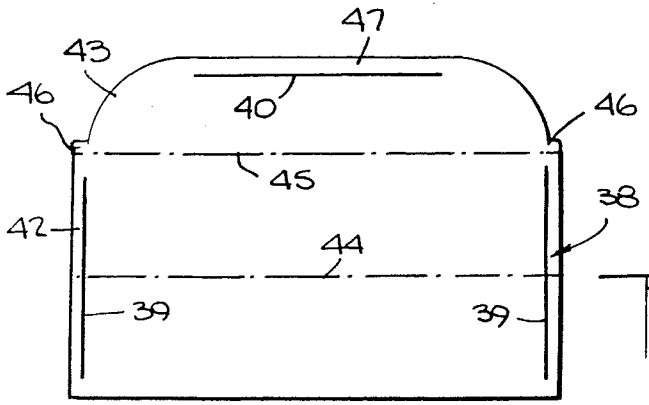
FIG. 12 illustrates a view of a blank having a shaped flap with remoistenable glue for making an envelope.

Referring to FIG. 12, a one-piece blank 38 may be provided with lines 39 of remoistenable glue rather than strips of glue as illustrated in FIG. 1. Further, a transverse line 40 of glue may also be provided at the upper edge.

As indicated in FIG. 12, the blank 38 may also be shaped in a manner so that the lower two sections 41, 42 which are of rectangular shape form the front and back of an envelope while the uppermost section 43 forms a shaped flap for closing the envelope. In this case, the lower sections 41, 42 are separated by a transverse fold line 44 and are of equal height as viewed, while the flap 43 is separated from the section 42 by a similar transverse fold line 45 and is of smaller height.

The flap 43 may be shaped as illustrated so as to have two shouldered portions 46 above the fold line 45 and a contoured closing portion 47 containing the tranverse line 40 of glue.

The blank 38 may be folded in a similar manner to the mailers described above with respect to FIG. 10. In this case, each blank 38 is moistened along the longitudinal edges to activate the remoistenable line 39 of glue. During folding, the lower two sections 41, 42 are wetted and folded together about the fold line 44 with or without the unwetted flap section 43 being folded down over the back of the lower section 41 to form an unsealed envelope which can be subsequently stuffed and mailed in the usual manner. One advantage of this construction is that the resulting envelope is of simple inexpensive construction. Thus, a multiplicity of such blanks 38 can be supplied to a bulk user in pre-addressed form or in blank. The user can then perform a printing and folding operation to suit the use desired.

As an alternative, the individual blanks may be "chopped" from a continuous web of paper so that the contour of the upper edge forming the flap section 43 is cut at the same time as the lower edge of the next blank is being cut. In this way, not only is the flap section formed with a contoured shape, but also the lower edge is formed with a recessed portion of mating shape. Thus, when the blank is subsequently folded into an envelope, the recess provides access into the pocket formed by the folded sections of the blank.

The laser printer (not shown) may be of any conventional structure, for example having a means for imaging a blank 10 passing therethrough and a heat generating fuser station. In this respect, the heat generating fuser station may generate temperatures in excess of 400° F. However, the glue being resistant to this temperature will not be impaired. In addition, the glue will retain its lay flat characteristics so that the blank can be conveyed through the printer in a lay flat condition.

Alternatively, the blanks 10 can be processed through a non-impact printer having a pressure or cold flow fuser station. In this case, the heat resistant characteristics of the glue do not come into play but the lay flat characteristics do. Further, the blanks 10 may be processed through impact printers without impairing the lay flat and remoistenable characteristics of the glue.

The invention thus provides a relatively simple and economical system for the printing, folding, addressing and sealing of a supply of one piece self mailers. The invention also provides a simple apparatus for the folding and sealing of one piece blanks into a mailer construction. Further, since the apparatus requires a rather inexpensive water applicator, the overall costs of making and using such an apparatus are at a relative minimum, for example as compared with folding equipment which require heaters in order to activate a hot melt glue on a mailer blank. Still further, since a remoistenable glue can be used, the costs of fabricating the one-piece mailer can be held to a minimum.

The invention further provides a foldable blank which can be processed through heat generating printers without impairing the bonding qualities of the glue on the blank which is subsequently use to seal the folded blank.

What is claimed is:

1. A one-piece mailer blank having at least two contiguous sections disposed for folding over on each other into overlying relation, each said section having remoistenable glue along the respective longitudinal edges for bonding said sections together, said glue characterized in being resistant to heat in excess of 400° F. and in providing lay flat characteristics.

2. A one-piece mailer blank as set forth in claim 1 wherein said glue is made of a vinyl copolymer dispersion adhesive.

3. A one-piece mailer blank as set forth in claim 1 having a longitudinal line of weakening adjacent each longitudinal edge with a respective strip of said glue therebetween.

4. A one-piece mailer blank as set forth in claim 1 wherein one of said sections has remoistenable glue disposed near a transverse edge thereof for bonding to the other section.

5. A one-piece mailer blank as set forth in claim 4 wherein said glue is in the form of a cross-web array of remoistenable glue dots.

6. A one-piece mailer as set forth in claim 1 wherein said glue is made of a vinyl acetate homopolymer emulsion base.

7. A mailer assembly having a plurality of interconnected one-piece blanks and a plurality of transverse burstable lines of weakening separating said blanks from each other, each said blank including at least two longitudinally contiguous sections, a pair of longitudinal lines of weakening extending with said sections at respective longitudinal edges thereof, remoistenable glue disposed on each section between a respective longitudinal edge and a respective line of weakening of a respective section, said glue characterized in being resistant to heat in excess of 400° F. and in providing lay flat characteristics.

8. A mailer assembly as set forth in claim 7 wherein each glue strip is made of a vinyl copolymer dispersion adhesive.

9. A mailer assembly as set forth in claim 7 wherein each blank has three longitudinally contiguous sections and a transverse fold line between each pair of said sections.

10. A mailer assembly as set forth in claim 9 wherein at least two sections have a pair of longitudinal glue strips thereon.

11. A mailer assembly as set forth in claim 7 which further comprises remoistenable glue disposed near a transverse edge of each blank.

12. A mailer assembly as set forth in claim 11 wherein said glue is a cross-web array of remoistenable glue dots.

13. A one-piece mailer blank having at least two contiguous sections disposed for folding over on each other into overlying relation, each said section having remoistenable glue along the respective longitudinal edges for bonding said sections together and a third section defining a flap for folding over one of said contiguous sections, said flap having remoistenable glue along a transverse edge for bonding said flap to said one section, said glue being characterized in being resistant to heat and in providing lay flat characteristics to permit processing through the feed paths of printers with heat and/or pressure generating fuser stations in a lay flat condition.

14. A one-piece mailer blank as set forth in claim 13 wherein said flap has a contoured shape.

15. A one-piece mailer blanks as set forth in claim 13 wherein said one section has a recess in a transverse edge.

16. A one-piece mailer having three contiguous paper sections disposed in folded overlying relation, two of said sections having remoistenable glue along a respective longitudinal edge bonding said two sections together and a third of said sections forming a flap and having remoistenable glue along a transverse edge bonding said flap to a rear of one of said two sections, said glue characterized in being resistant to heat in excess of 400° F. and in providing lay flat characteristics.

17. A one-piece mailer as set forth in claim 16 wherein said glue is made of a vinyl copolymer dispersion adhesive.

18. In combination a supply of blanks, each blank having at least a pair of foldable sections and a remoistenable glue on at least one section for securing said sections together upon folding;

a printer for sequentially receiving said blanks and having means for imaging a blank of said supply passing therethrough; and an apparatus for folding and sealing a blank received from said printer, said apparatus including a feed means conveying a blank therethrough, means for applying water to at least one side of a conveyed blank to activate the glue thereon, and means for folding said sections of a conveyed blank into overlying relation while pressing the opposed sections together to permit the activated glue to bond said sections together.

19. A combination as set forth in claim 18 wherein each blank has three of said sections and wherein said means for folding folds each blank with said three sections in overlying relation.

20. The combination as set forth in claim 18 wherein said means for applying water includes a water reservoir disposed adjacent a conveyed blank in said feed means and an applicator for transferring water from said reservoir to a conveyed blank.

21. The combination as set forth in claim 18 wherein said blanks are interconnected in said supply to define a continuous self mailer assembly.

22. The combination as set forth in claim 18 wherein said printer is a non-impact printer having a ink fusing station thereing.

23. The combination as set forth in claim 22 wherein said printer has a heat generating ink fusing station and said glue is heat resistant to the heat generated in said station.

24. The combination as set forth in claim 23 wherein each blank has preprinted information thereon of heat resistant printing ink.

25. A method of processing self mailers comprising the steps of providing a supply of one-piece blanks, each blank having at least two sections with at least one section having a remoistenable glue thereon, said glue being heat resistant to permit said blank to be fed through a heat generating fuser station of a printer;

passing each blank through a non-impact printer having a heat generating fuser station to impart imaged variable information on each blank;

wetting each blank in a region of the glue to activate the glue; and folding the sections of each blank into facing relation to secure the sections together in glued relation.

26. A method of processing self mailers comprising the steps of providing a self mailer assembly having a plurality of interconnected blanks, each blank having at least two sections with at least one section having a remoistenable glue thereon;

passing the assembly through a printer having means to impart imaged variable information on each blank;

thereafter separating each imaged blank from the mailer assembly;

wetting each blank in a region of the glue to activate the glue; and folding the sections of each blank into facing relation to secure the sections together in glued relations.

27. A one-piece mailer blank for processing through a sheet feed non-impact printer having a heat generating fuser station having at least two contiguous sections disposed for folding over on each other into overlying relation, each said section having remoistenable glue along the respective longitudinal edges for bonding said sections together, said glue characterized in being resistant to heat in excess of 400° F. generated in the fuser station and in providing lay flat characteristics to said section.

28. A one-piece mailer blank as set forth in claim 27 wherein one of said sections has a plurality of remoistenable glue dots disposed near a transverse edge thereof for bonding to the other section.

29. A one-piece mailer blank as set forth in claim 27 which further comprises a third section disposed for folding over one of said two sections, said third section having remoistenable glue along respective longitudinal edges thereof, at least one of said sections having preprinted information made of heat resistant print press ink.

30. A one-piece mailer blank as set forth in claim 29 having a cut-out in a central section and a transparent panel secured over said cut-out.

31. A one piece mailer blank for processing through a sheet feed non-impact printer having a cold flow fuser station, said blank having at least two contiguous sections disposed for folding over on each other into overlying relation, each said section having remoistenable glue along the respective longitudinal edges for bonding said sections together, said glue characterized in being heat resistant and in providing lay flat characteristics to said section to permit said blank to be fed through a feed path and a fuser station of the printer.

32. A one-piece mailer blank as set forth in claim 31 wherein said glue is made of a vinyl copolymer dispersion adhesive.

* * * * *

UNITED STATES PATENT AND TRADEMARK OFFICE

CERTIFICATE OF CORRECTION

PATENT NO. : 4,951,864

DATED : August 28, 1990

INVENTOR(S) : DAVID DICKER

It is certified that error appears in the above-identified patent and that said Letters Patent is hereby corrected as shown below:

Title page, item 73 change "Granville" to -Brewster-
Column 2, line 47 change "porocessing" to -processing-
Column 3, line 65 change "or blanks" to -of blanks-
Column 8, line 13 change "use" to -used-
Column 9, line 16 change "blanks" to -blank-
Column 9, line 63 change "a ink" to -an ink-
Column 9, line 64 change "thereing" to -therein-
Column 10, line 31 change "relations" to -relation-

Signed and Sealed this

Third Day of March, 1992

*Attest:*

HARRY F. MANBECK, JR.

*Attesting Officer*

*Commissioner of Patents and Trademarks*